US007261133B1

(12) United States Patent
Copeland

(10) Patent No.: US 7,261,133 B1
(45) Date of Patent: Aug. 28, 2007

(54) REINFORCED WALLET

(76) Inventor: William A. Copeland, 39 Pebble La., N. Falmouth, MA (US) 02556

( * ) Notice: Subject to any disclaimer, the term of this patent is extended or adjusted under 35 U.S.C. 154(b) by 0 days.

(21) Appl. No.: 10/892,266

(22) Filed: Jul. 16, 2004

(51) Int. Cl.
*A45C 1/06* (2006.01)
*A45C 13/08* (2006.01)
*A45C 13/36* (2006.01)

(52) U.S. Cl. ..... 150/145; 150/131; 150/132

(58) Field of Classification Search ..... 150/131, 150/132, 134, 145, 133, 137, 147–149
See application file for complete search history.

(56) References Cited

U.S. PATENT DOCUMENTS 286,650 A 10/1883 Talcott
720,467 A * 2/1903 Oertel ..... 150/131
804,445 A 11/1905 Tice
1,314,392 A 8/1919 Glamzo
1,326,602 A 12/1919 McKey
1,672,766 A 6/1928 March
1,973,420 A 9/1934 Trussell
D111,621 S 10/1938 Stanley
2,383,108 A 8/1945 Cibert
2,397,439 A * 3/1946 Schwartz ..... 150/131
2,550,437 A 4/1951 Yates
2,647,071 A 7/1953 Schade
2,650,700 A * 9/1953 Wolf ..... 206/5
2,693,213 A * 11/1954 Marcus ..... 150/132
2,720,904 A 10/1955 Jeffery
2,727,549 A * 12/1955 Knee ..... 150/133
2,729,009 A * 1/1956 Markus et al. ..... 428/43
2,732,875 A * 1/1956 Martin ..... 150/147
2,788,041 A 4/1957 Carver
2,835,300 A * 5/1958 Silha ..... 150/132
2,891,340 A * 6/1959 Markus et al. ..... 428/79
2,897,606 A 8/1959 Rosa
3,051,600 A * 8/1962 Markus et al. ..... 428/139
3,230,993 A * 1/1966 Smith et al. ..... 150/131
3,267,980 A * 8/1966 Bird ..... 150/135
3,280,870 A * 10/1966 Bundy ..... 206/526
3,559,798 A * 2/1971 Jacobsen ..... 206/5
D222,602 S 11/1971 Petrie
3,757,840 A 9/1973 Herbener
3,759,305 A * 9/1973 McIntyre ..... 150/149
4,061,822 A * 12/1977 Brodnyan et al. ..... 428/314.2
4,194,655 A 3/1980 Tillotson
4,209,048 A * 6/1980 Sandos ..... 150/132
4,247,350 A * 1/1981 McIntyre et al. ..... 156/216
4,593,736 A 6/1986 Morita
4,705,086 A * 11/1987 O'Neill ..... 150/134
4,852,736 A 8/1989 Kojima et al.
4,899,873 A * 2/1990 Bolle et al. ..... 206/5
4,934,520 A 6/1990 Okada
5,107,073 A 4/1992 Steffen
5,452,793 A 9/1995 DiMeo, Jr. et al.
5,513,744 A 5/1996 Yabarra
D370,558 S 6/1996 McGinnis
5,595,293 A * 1/1997 Miller ..... 206/308.1
RE36,208 E 5/1999 Steffen
5,914,657 A * 6/1999 Chen ..... 340/568.7
6,361,210 B2 3/2002 Denko
6,505,987 B1 1/2003 Turner, III et al.
6,651,813 B2 11/2003 Vallans et al.
2004/0250933 A1* 12/2004 DeMichele ..... 150/145

* cited by examiner

*Primary Examiner*—Sue A. Weaver
(74) *Attorney, Agent, or Firm*—John P. McGonagle

(57) ABSTRACT

A wallet having hardened reinforcing plates, as well as a dust-tight and water impervious cover. The wallet also has two Styrofoam layers.

3 Claims, 1 Drawing Sheet

REINFORCED WALLET

BACKGROUND OF THE INVENTION

This invention relates to wallets, and in particular, to a wallet reinforced to protect the contents from external forces such as crushing, dust, dirt, water and the like.

Nearly all men carry some type of wallet on their person. Such wallets are used to carry money, identification papers, credit cards, bank cards and the like. Although prior art wallets are adequate for this purpose in most instances, they are not adequate for people in certain fields or endeavors, such as the construction trades, firemen, camping, hunting, etc. In these fields and endeavors, people carrying the wallets are subject to often hostile environments containing, dirt, water, dust, and physical bumps and other external forces. The result of these hostile environments on prior art wallets are damaged and often ruined wallet contents, especially to credit and bank cards.

SUMMARY OF THE INVENTION

The present invention provides a reinforced wallet with the ability to protect the wallet's contents from hostile external forces. The present invention does this by providing a wallet having one or more reinforcing plates, as well as a dust-tight and water impervious cover.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 2:
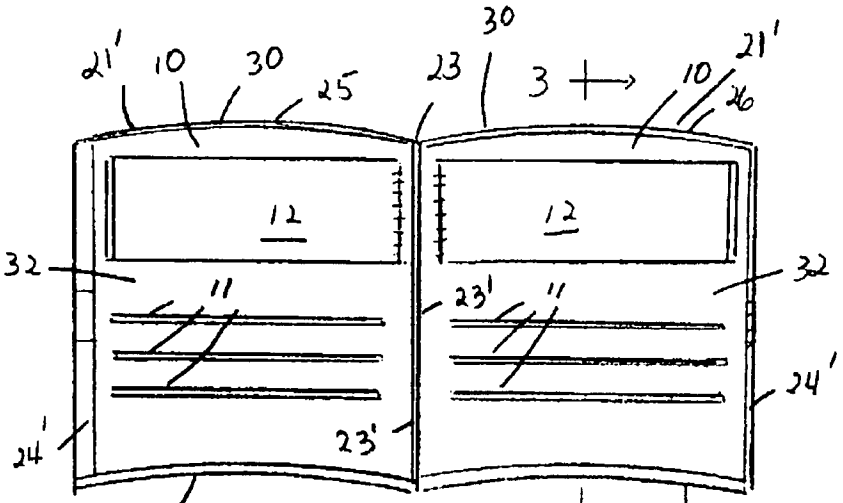
FIG. 2 is a front view of the invention in an open position.
Figure 3:
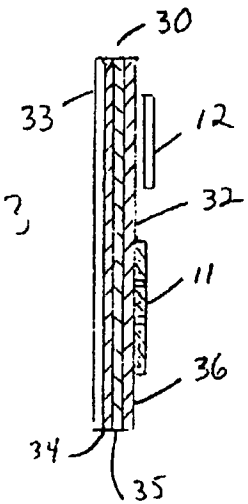
FIG. 3 is a sectional view along the line 3-3 of FIG. 2.
Figure 4:
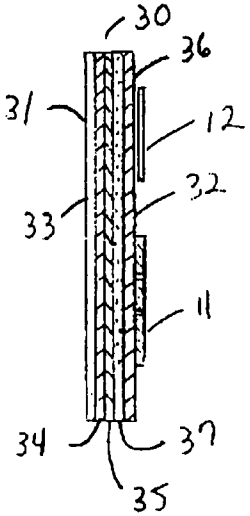
FIG. 4 is a sectional view along the line 3-3 of FIG. 2 showing the addition of a floatation layer.
Figure 1:
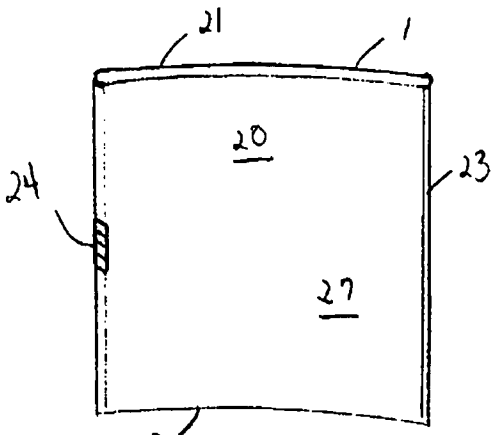
FIG. 1 is a front perspective view of the invention in a closed position.

Referring to the drawings in detail wherein like elements are indicated by like numerals, there is shown a wallet 1 constructed according to the principles of the present invention. The wallet 1 has a standard internal arrangement 10 containing pockets 11 and transparent picture and card holders 12. The internal arrangement 10 could be any desired arrangement without affecting the principles of the present invention.

The wallet 1 has a generally rectangular wallet structure 20 with a top 21, a bottom 22, a hinged side 23 and a connector side 24. The wallet structure 20 is comprised of two halves 25, 26 each pivotally joined along one edge, said joined edges forming the wallet structure hinged side 23. The two halves 25, 26 are adapted to being folded about the hinged side 23 against each other and enclosing the wallet internal arrangement 10. When closed the wallet 1 presents an exterior surface 27. The halves 25, 26 each have four edges 21', 22', 23', and 24' which are adapted to forming a water-tight seal when the wallet 1 is closed.

Each wallet half 25, 26 forms a wallet wall 30 with an exterior side 31 forming a portion of the wallet exterior surface 27 and an interior side 32 supporting the wallet internal arrangement 10. Each wallet wall 30 is comprised of a plurality of layers. The first layer 33 forms the wall exterior side and is comprised of a water impervious material. This layer 33 may be transparent as well. The second layer 34 is comprised of leather or other decorative material, said second layer 34 being adjacent said first layer 33. The first and second layers 33, 34 may be combined and made of a material which is both decorative and water impervious. The third layer 35 is made from a hardened material such as stainless steel, hard rubber, hard plastic, or the like. The fourth layer 36 is made from the same material as the second layer 34. The fourth layer 36 forms the interior side 32 supporting the wallet internal arrangement 10. In another embodiment of the invention, a fifth layer 37 is added to make the wallet floatable. The fifth layer 37 would me made from some type of floatation material, such as sold under the trademark, Styrofoam, or the like. Preferably, the fifth layer would be positioned adjacent the third layer 35.

The wallet halves' first layer 33 and water tight seal provides a water impervious and dust tight enclosure about the wallet internal arrangement 10. The hard material in the wallet third layer 35 protects the wallet internal arrangement from external forces and crushing. The decorative aspect of the halves' second and fourth layers 34, 36, combined with the transparent first layer 33, hides the reinforcing aspects of the invention. Use of a fifth floating layer 37 makes the present invention functional for fishermen, dock workers, and the like. The wallet 1 may be contoured to provide a better fit when placed into a wearer's rear pocket.

It is understood that the above-described embodiment is merely illustrative of the application. Other embodiments may be readily devised by those skilled in the art which will embody the principles of the invention and fall within the spirit and scope thereof.

I claim:

1. A reinforced wallet having an internal arrangement containing pockets and transparent picture and card holders, comprising:

a generally rectangular wallet structure with a top, a bottom, a hinged side and a connector side, said wallet structure being comprised of two halves each pivotally joined along one edge, said joined edges forming the wallet structure hinged side, said two halves adapted to being folded about the wallet hinged side against each other and enclosing the wallet internal arrangement;

wherein each wallet half forms a wallet wall with an exterior side forming a portion of a wallet exterior surface and an interior side supporting the wallet internal arrangement, each wallet wall being comprised of a plurality of layers;

wherein said plurality of layers are comprised of:

a first layer forming the wall exterior side, said first layer being comprised of a transparent, water impervious material;

a second layer being comprised of a decorative material, said second layer being adjacent said first layer;

a third layer made from a hardened material selected from a group of materials comprised of stainless steel, hard rubber and hard plastic; and a fourth layer made a decorative material, said third layer being sandwiched between said second and fourth layers, said fourth layer forming the wallet interior side supporting the wallet internal arrangement.

2. A reinforced wallet as recited in claim 1, further comprising:

a fifth layer made of flotation material, said fifth layer being positioned adjacent the third layer.

3. A reinforced wallet as recited in claim 1, wherein:

the first and second layers are combined and made of a material which is decorative and water impervious.

* * * * *